US005901516A

United States Patent [19]

Watson

[11] Patent Number: 5,901,516

[45] Date of Patent: May 11, 1999

[54] SNAP ON BASEBOARD SYSTEM

[76] Inventor: Zane D. Watson, 45-011 Lilipuna Rd., Kaneohe, Hi. 96744

[21] Appl. No.: 08/780,819

[22] Filed: Jan. 9, 1997

Related U.S. Application Data

[63] Continuation-in-part of application No. 08/365,474, Dec. 28, 1994.

[51] Int. Cl.[6] ..... E04F 19/04

[52] U.S. Cl. ..... 52/288.1; 52/242; 52/290; 52/716.8; 52/718.04

[58] Field of Search ..... 52/287.1, 288.1, 52/290, 241, 242, 716.8, 718.01, 718.04, 718.06, 745.06, 745.01, 745.11, 745.13, 745.2

[56] References Cited

U.S. PATENT DOCUMENTS

| | | | |
|---|---|---|---|
| 2,029,549 | 2/1936 | Winterich . | |
| 2,277,794 | 3/1942 | Small . | |
| 2,316,980 | 4/1943 | Sigloch et al. . | |
| 2,887,870 | 5/1959 | Slowinski . | |
| 3,074,521 | 1/1963 | Woods | 52/241 X |
| 3,161,926 | 12/1964 | Schaub | 52/241 X |
| 3,217,452 | 11/1965 | Steele | 52/241 X |
| 3,228,160 | 1/1966 | O'Brien . | |
| 3,423,892 | 1/1969 | Rimington | 52/241 |
| 3,690,083 | 9/1972 | Miller . | |
| 4,461,135 | 7/1984 | Anderson et al. . | |
| 4,622,791 | 11/1986 | Cook et al. . | |
| 4,913,576 | 4/1990 | Grant, Jr. . | |
| 5,146,723 | 9/1992 | Greenwood et al. . | |

FOREIGN PATENT DOCUMENTS

| | | |
|---|---|---|
| 239684 | 7/1960 | Australia . |

*Primary Examiner*—Robert Canfield
*Attorney, Agent, or Firm*—Lynn & Lynn

[57] ABSTRACT

A spacer and tension clip mount a baseboard to a wall in a manner such that the baseboard can be easily removed and then remounted to the wall. Corner modules mount to the baseboards to finish corners without requiring precise cutting to from corner joints.

4 Claims, 13 Drawing Sheets

SNAP ON BASEBOARD SYSTEM

CROSS-REFERENCE TO RELATED APPLICATION

This is a continuation-in-part of U.S. patent application Ser. No. 08/365,474, which was filed on Dec. 28, 1994.

BACKGROUND OF THE INVENTION

This invention relates generally to construction techniques for homes and offices and particularly to mounting baseboards to the lower edges of walls. Still more particularly, this invention relates to a snap on baseboard mounting system that permits easy attachment of a baseboard to a wall and subsequent removal of the baseboard from the wall for inspection, painting, wall papering, etc.

In Hawaii, and some other similar environments, there is a very bad termite situation. The chemicals now being used have very little affect on the subterranean termite. The only way to protect a home effectively is to do a visual inspection of the plate and wall studs to see if an area is being attacked by the termites.

Standard wall construction procedure involves nailing sheets of drywall to studs, leaving a rough, unfinished bottom edge. Elongate pieces of molding or other types of baseboards are attached to the studs adjacent the floor to cover the lowermost portion of the drywall. Typically baseboards are attached to the wall using nails or staples. Removing baseboards that have been mounted using nails or staples is time-consuming and usually results in significant damage to the wall, the baseboard or both.

Thus there is a need for an improved technique for mounting baseboards to walls. In some environments it is necessary to remove baseboards to permit visual inspection of the space between the studs and drywall for infestation by rodents and insects such as termites, ants, spiders, centipedes. For new and remodeling construction, having baseboards that are easy to remove would greatly facilitate adding or changing the wall coatings and floor.

SUMMARY OF THE INVENTION

The present invention provides an apparatus and method for mounting a baseboard to a wall in a manner such that the baseboard can be easily removed and then remounted to the wall to allow one to find and destroy or remove insect and rodent infestations at the ground level before they go up the walls and cause substantial structural problems. The present invention therefore can save the home owner substantial money and inconvenience associated with major repairs.

The apparatus according to the present invention for demountably attaching a baseboard to a wall having a selected thickness and having a lower edge that is spaced apart by a selected distance from a floor comprises a spacer having a thickness that is approximately the same as the wall thickness. The space has a width that is less than the distance between the lower edge of the wall and the floor. The spacer is connected to the baseboard proximate a lower edge of the wall. The invention further includes a tension clip having a first end that is connected to the spacer and a second end that extends from the spacer. The second end of the tension clip may be inserted into the space below the wall such that the lower edge of the baseboard may be manually rotated toward the floor to mount the baseboard on the wall such that a portion of the wall adjacent the lower edge of the wall is retained between the baseboard and the second portion of the tension clip.

The apparatus according to the present invention may further comprise a tongue and groove configuration formed in the lower back portion of the baseboard. The tongue and groove are arranged to be generally vertical when the baseboard is installed on the lower edge of the wall. A prong is formed on the tension clip and configured to extend into the groove. A spring portion is connected to the prong and so that it extends generally upward from the tongue so that the lower portion of the wall is retained between the spring portion and the baseboard when the baseboard is installed.

The according to the present invention may further include a horizontal slot formed in the rearward-facing surface of the spacer. A projection is formed in the spring portion and configured to extend into the horizontal slot. The projection and the prong are preferably arranged to provide a compressive force on the tongue to maintain the connection between the tension clip and the spacer.

The spacer and the tension clip are integrally formed to have a mounting flange that is connected to the back surface of the baseboard near the lower edge. A spacer section extends generally perpendicularly from the mounting flange, and a spring portion that extends from the spacer section to retain the lower portion of the wall between the spring portion and the baseboard.

An appreciation of the objectives of the present invention and a more complete understanding of its structure and method of operation may be had by studying the following description of the preferred embodiment and by referring to the accompanying drawings.

DESCRIPTION OF THE PREFERRED EMBODIMENT

Figure 1:
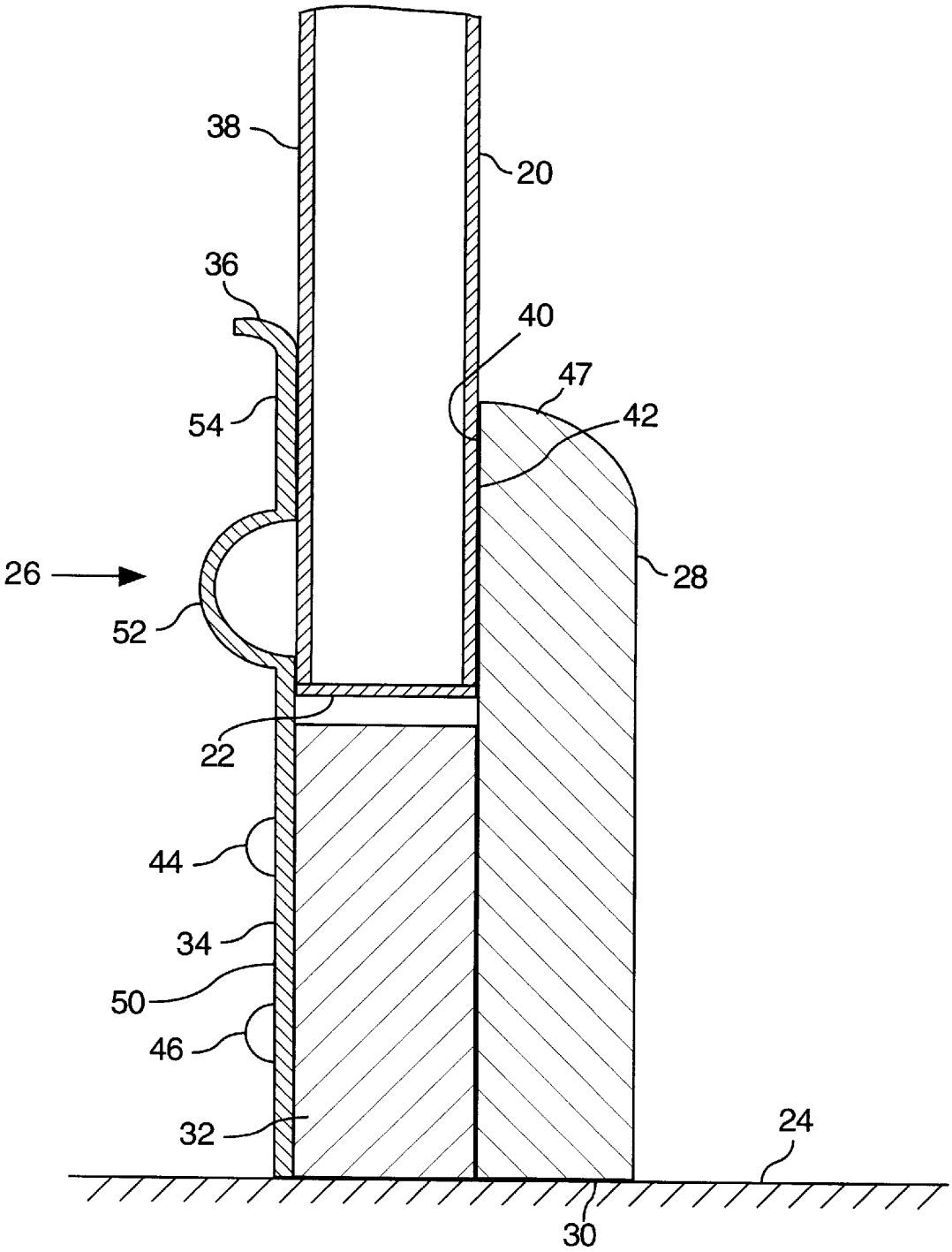
FIG. 1 is a cross-sectional view illustrating a sheet of gypsum board, a baseboard, and a tension clip apparatus according to the present invention for mounting the baseboard to the gypsum board.
Figure 2:
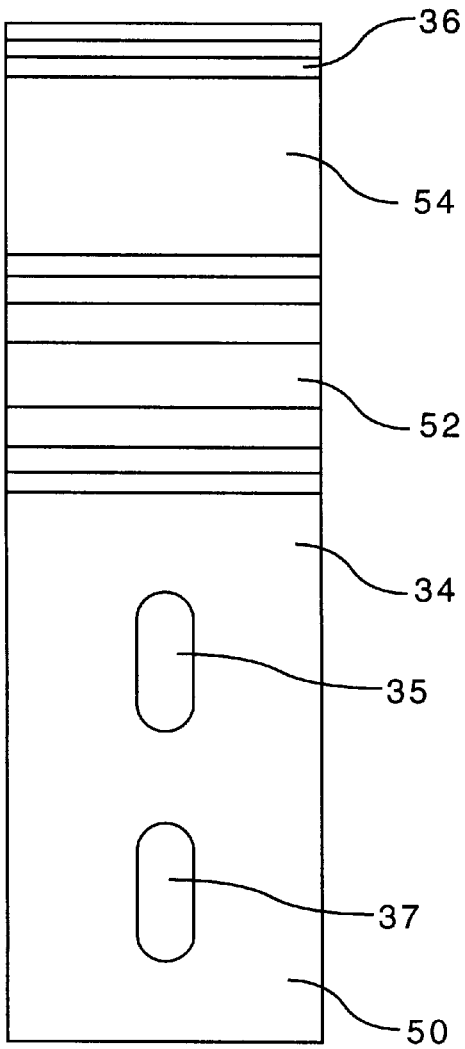
FIG. 2 is an expanded front elevation view of a first embodiment of a tension clip that may be included in the apparatus of FIG. 1.
Figure 3:
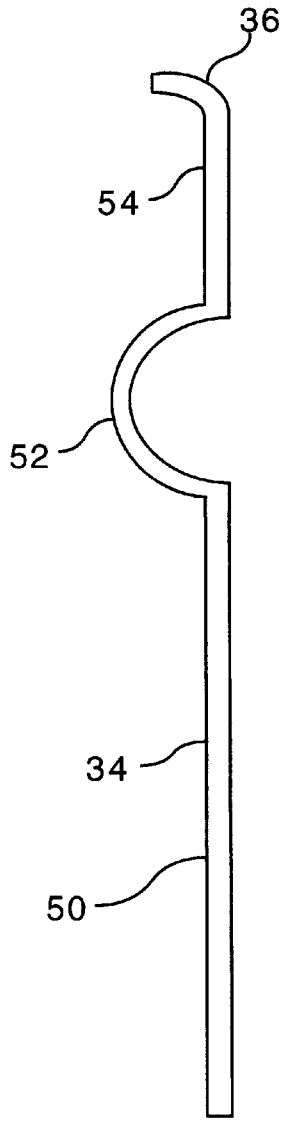
FIG. 3 is an expanded side right side elevation view of the tension clip of FIG. 2.

Referring to FIGS. 1–3, there is shown a portion of a wall 20 that is preferably formed of conventional drywall or the like. The wall 20 has a lower edge 22 that is spaced apart by a distance of about 2.0" to 2.5" from a floor 24.

A snap on clip assembly 26 according to the present invention connects a baseboard 28 to the wall 20. The baseboard has a lower edge 30 that extends to a location near the floor 24. The snap on clip assembly 26 may be used to place the baseboard 28 in contact with the floor 24 in applications where either no floor covering or a thin floor covering is to be used.

For existing walls, the dry wall is cut so that there is an appropriate space between the floor 24 and the lower edge 22 of the wall 20. This space is necessary to make a visual inspection for termites, other pests and rot. After the inspection, the baseboard is mounted to the wall in accordance with the present invention. With new construction, the drywall installers leave the appropriate space between the lower edge 22 of the wall 20 and the floor 24 for installation of the baseboard in the manner described herein.

The snap on clip assembly 26 as shown in FIG. 1 includes a spacer 32, which may be made of wood, plastic or the like and a tension clip 34. The tension clip 34 is preferably formed of metal or plastic. However, other materials may be suitable for forming the tension clip 34. The essential feature of the material and structure of the tension clip 34 is that they must provide sufficient flexibility and elasticity to permit installation of the baseboard and then retain the baseboard 28 in position on the wall. When the baseboard 28 and snap on clip assembly 26 are mounted to the wall 20, an upper end 36 of the tension clip 34 presses against the back surface 38 of the wall 20 while the back surface 40 of the baseboard 28 presses against the front surface 42 of the wall 20. The elastic force in the tension clip 34 thus retains the baseboard 28 and the snap on clip assembly 26 in position on the wall 20.

Referring to FIGS. 1–3, the spacer 32 is connected to the back surface 27 of the baseboard 28 by suitable fasteners or by an adhesive. The tension clip 34 is similarly connected to the spacer 32. As shown, the tension clip 34 has two passages 35 and 37 that may be used to receive screws 44 and 46, respectively. Nails or other such fasteners may also be used to mount the tension clip 34 to the spacer 32. The baseboard 28 with the snap on clip assembly 26 connected thereto is mounted to the wall 20 by first placing the back 40 of the baseboard 28 facing the floor 24. The baseboard 28 is then moved toward the wall 20 until the upper end 36 of the tension clip 34 under the lower edge 22 of the wall 20 until the upper edge 47 of the baseboard is near the front surface 42 of the wall 20. The baseboard 28 is then rotated clockwise as seen in FIG. 1. This rotation of the baseboard 28 causes the upper portion 36 of the tension clip 34 to press against the back 38 of the wall 20. Installation is completed by continued rotation of the baseboard 28 until the spacer 32 is under the lower edge 22 of the wall 20 and the baseboard 28 is in the desired position against the front surface 42 of the wall 20.

The tension clip 34 of the embodiment shown in FIGS. 1–3 has an essentially straight, flat lower portion 50 that is connected to the spacer 32. The lower portion 50 extends to a curved portion 52 that is preferably just above the center of the tension clip 34. The curved portion 52 may be essentially semicircular when viewed from the side as in FIGS. 1 and 3. A second straight portion 54 extends from the curved portion 52 to the end 36 of the tension clip 34. The upper end 36 of the tension clip 34 preferably is curved away from the back of the baseboard 28 to prevent the tip of the tension clip 34 from snagging on the back of the wall during installation.

The straight lower portion 50 is connected to the spacer 32. While the baseboard is being mounted or removed from the wall 20, the tension clip 34 bends away from the baseboard at the curved portion 52 and the second straight portion 54. As the baseboard assumes its installed position on the wall, the elastic forces cause the bent portions of the tension clip 34 to tend to return to their normal positions as shown in FIG. 1.

Referring to FIGS. 2 and 3, the tension clip 34 preferably is about 1.0" to 2.0" wide. The lower straight portion 50 preferably is about 2.25" to 2.75" long. The distance along the chord between the ends of the curved portion 52 preferably is about 1.0" to 1.5". The upper straight portion preferably has a length of about 1.0" to 1.5". The upper end 36 of the tension clip 34 preferably is curved as an arc of a circle having a diameter of 0.125" to 0.25".

Figure 4:
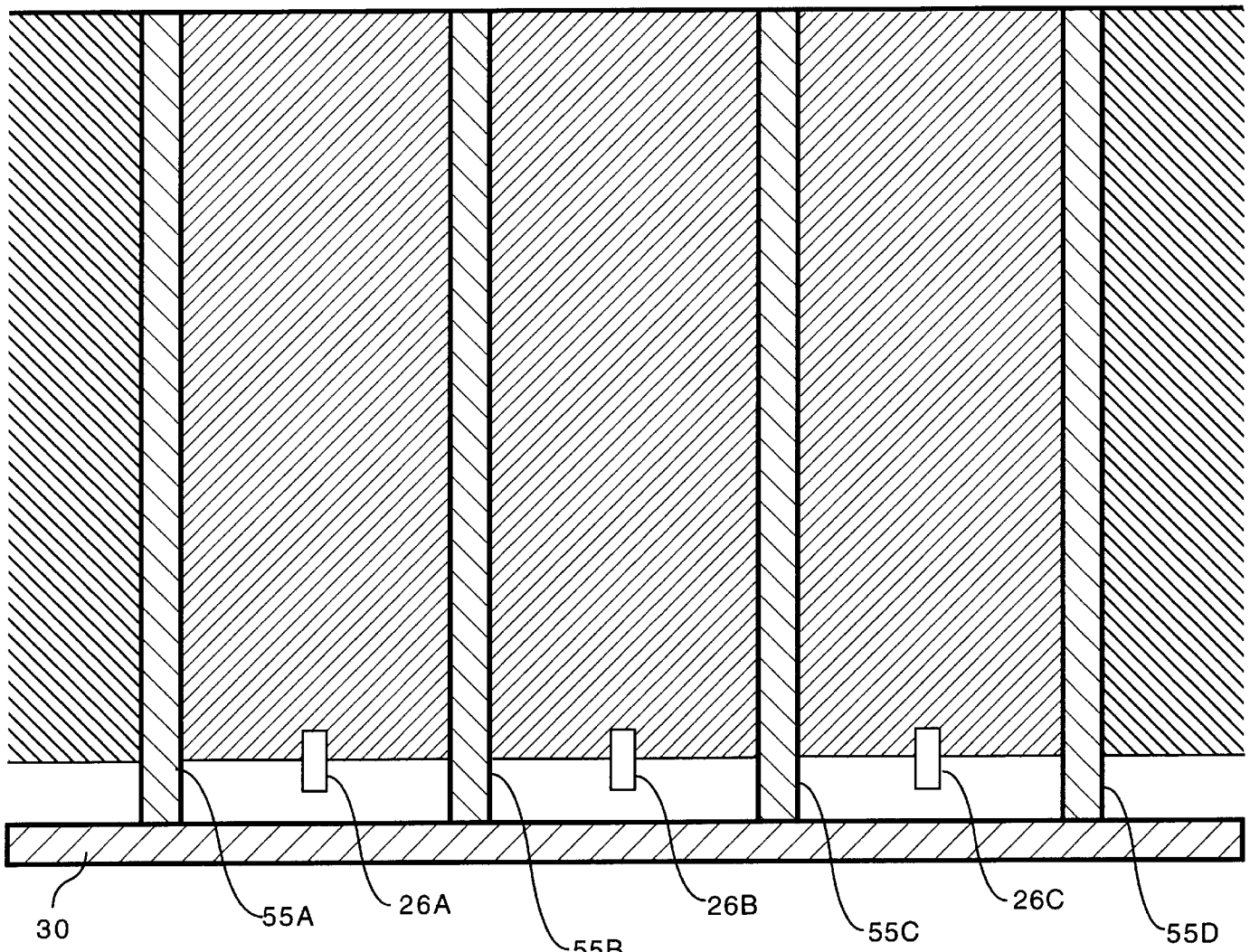
FIG. 4 is an elevation view showing a baseboard mounted to a wall using a plurality of tension clips according to the present invention.

FIG. 4 is a back side elevation view of the wall 20 with a length of baseboard 28 installed using a plurality of snap on clip assemblies 26A, 26B and 26C according to the present invention. The wall is 20 is shown mounted to a plurality of studs 55A, 55B, 55C and 55D. The snap on clip assemblies 26A, 26B and 26C are shown to be approximately midway between adjacent studs. The snap on clip assemblies 26A, 26B and 26C could be at other locations. The only requirement for the locations of the snap on clip assemblies 26A, 26B and 26C is that they must not be placed immediately opposite a wall stud, a conduit, pipe or the like that would prevent the baseboard from being properly installed.

Figure 6:
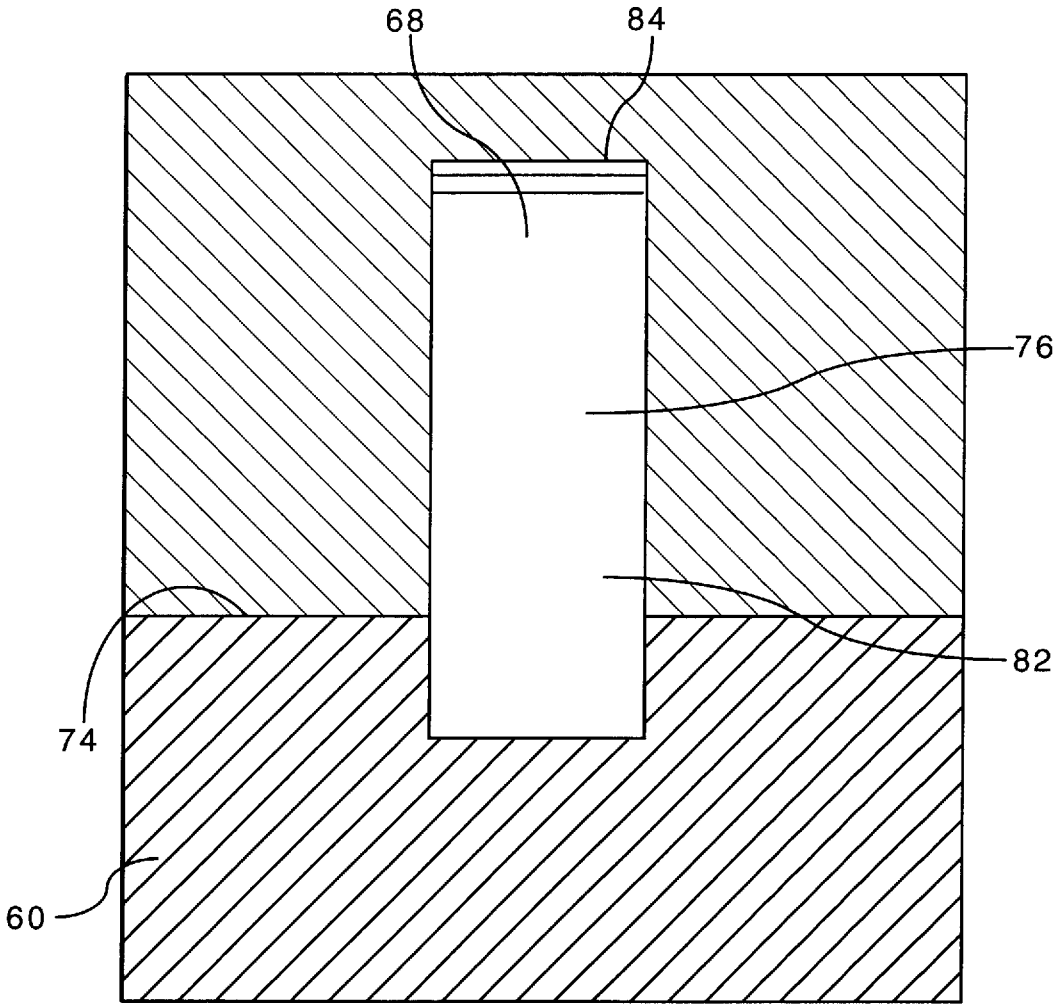
FIG. 6 is a front elevation view of the apparatus of FIG. 5.
Figure 5:
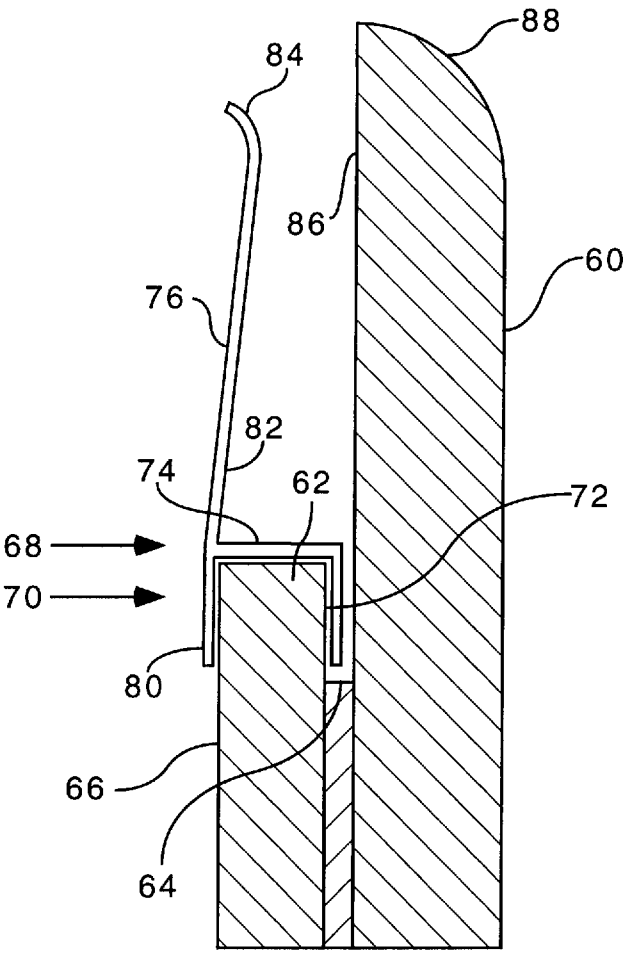
FIG. 5 is a cross-sectional view showing a second embodiment of a tension clip apparatus according to the present invention for mounting a baseboard to a wall.

FIGS. 5 and 6 show a second embodiment of the invention. A baseboard 60 is formed to have a tongue 62 extending parallel the height of the baseboard. A groove 64 is formed between the tongue and the lower portion of the back side 66 of the baseboard 60. The combined width of the tongue 62 and the groove 64 is about the same as the thickness of the wall 20 shown in FIG. 1.

A tension clip 68 has a base 70 that is mounted to the baseboard 60 using the tongue 62 and the groove 64. A prong 72 extends essentially perpendicularly from the base 70 into the groove 64. The base 70 extends across the end 74 of the tongue 64, which preferably is flat. A spring member 76 extends essentially perpendicularly from the base to extend down the outer surface 80 of the lower portion of the baseboard 60. The spring member has a straight section 82 that extends upward from the base 70 to a curved end 84. In its unstressed configuration, the spring member 76 angles toward the back surface 86 of the upper edge 88 of the baseboard 60. Therefore, when the baseboard is installed on a wall, the spring member presses against the wall 20 to retain the baseboard 60 in its installed position. The tongue and groove arrangement on the lower edge of the baseboard 60 may be formed by attaching a spacer (not shown) to a conventional baseboard.

Figure 8:
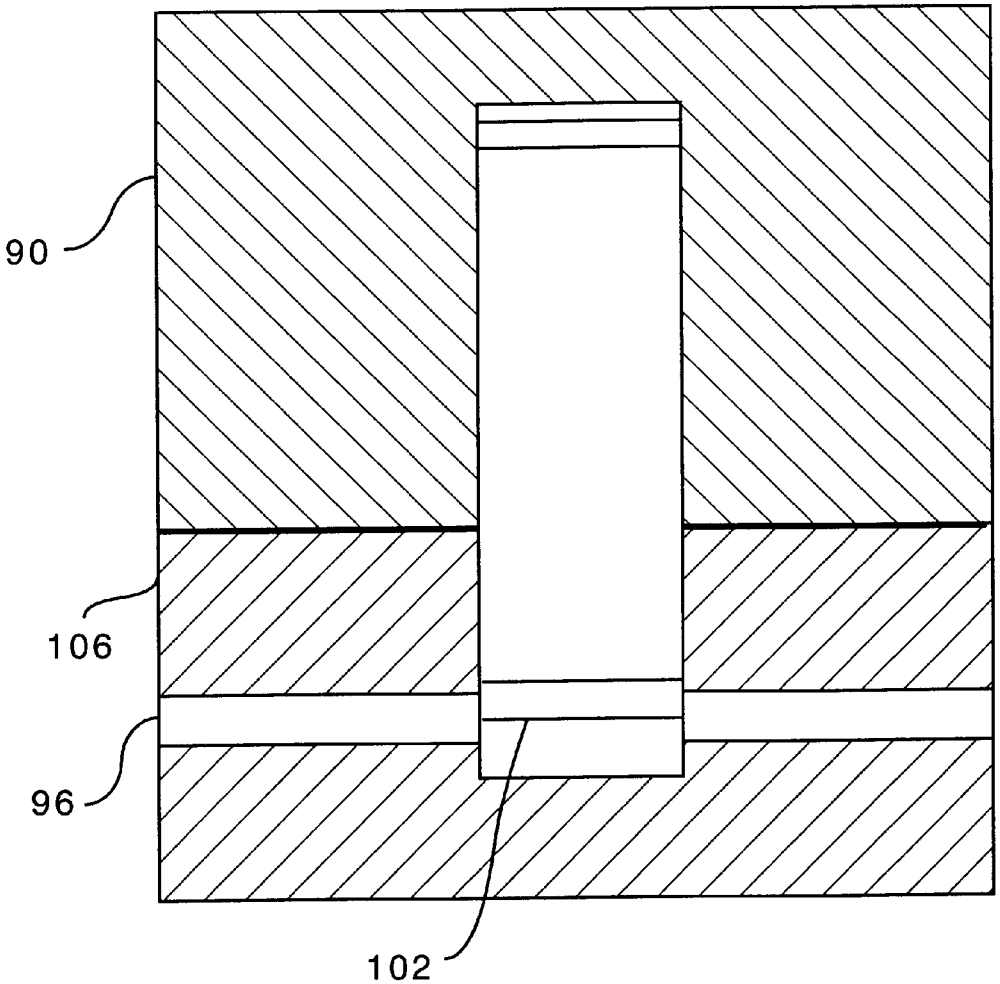
FIG. 8 is a front elevation view of the apparatus of FIG. 7.
Figure 7:
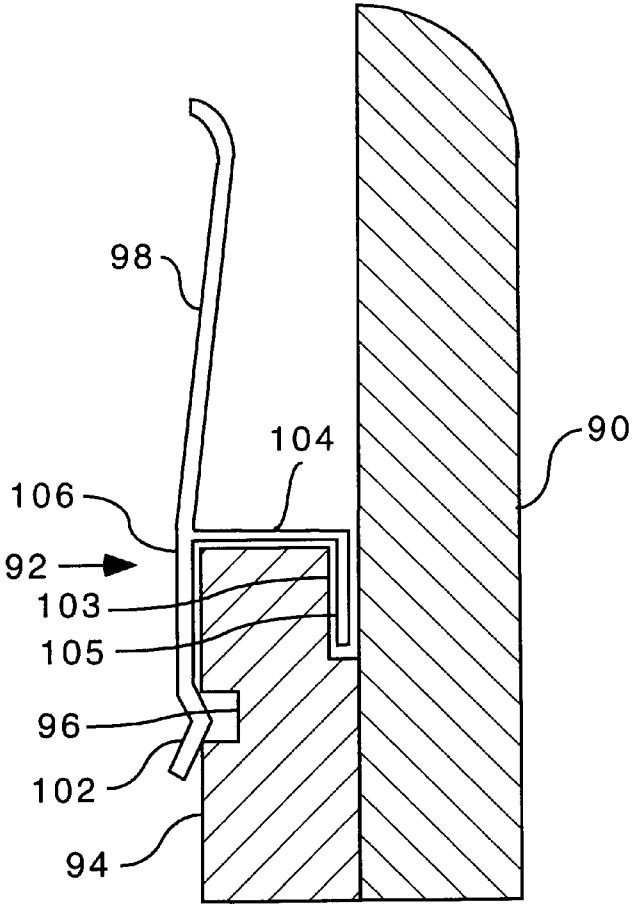
FIG. 7 is a cross-sectional view showing a third embodiment of a tension clip apparatus according to the present invention for mounting a baseboard to a wall.

FIGS. 7 and 8 illustrate a baseboard 90 and tension clip 92 that are similar to the base board 60 and tension clip 68 of FIGS. 5 and 6. The back edge 94 of the baseboard 90 has a slot 96 formed therein. A spring member 98 has a lower portion 100 that includes a projection 102 that is configured to fit in the slot 96. A prong 103 extends from the base 104 of the tension clip 92 into a groove 105 formed in the baseboard 90 in an arrangement similar to that of the tongue 62 and groove 64 of FIG. 5. The prong 103 and the projection 102 are preferably configured to maintain a compressive force on the tongue 106 upon which the tension clip 92 is mounted. The projection 102 and the prong 103 grip the tongue 106 to provide a secure connection between the tension clip 92 and the baseboard without using adhesives or fasteners.

Figure 10:
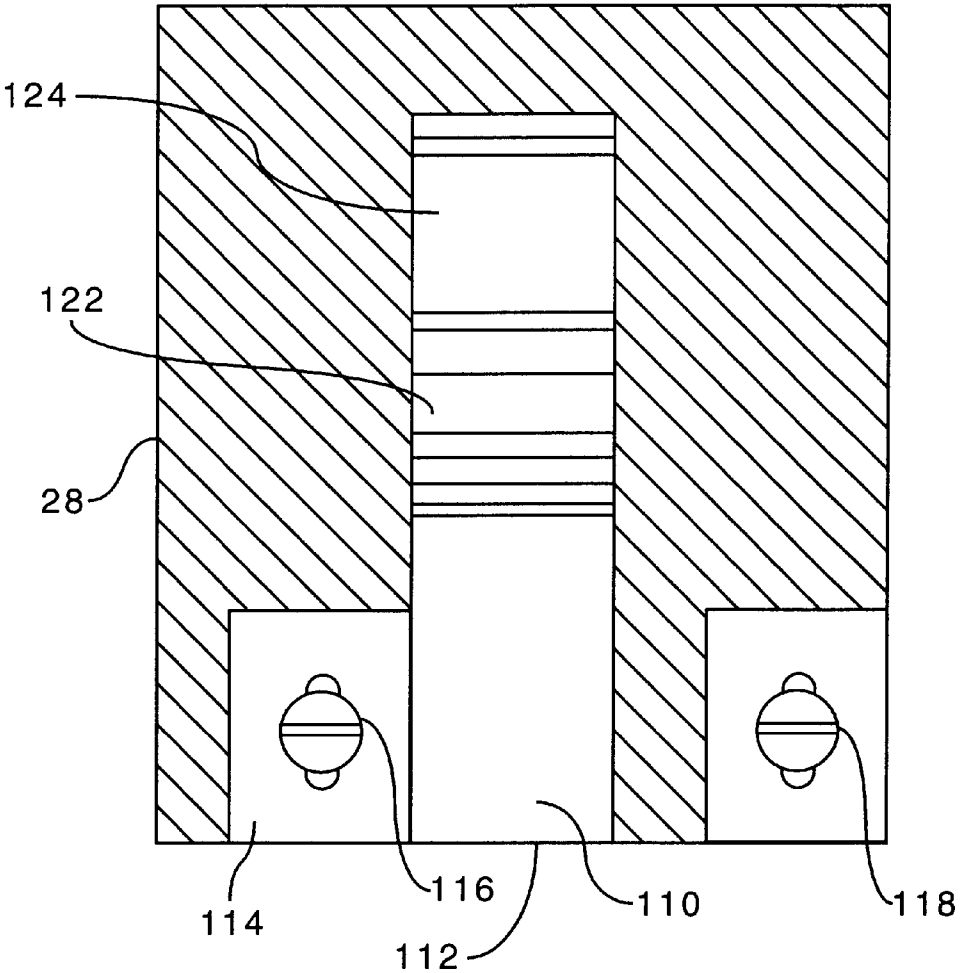
FIG. 10 is a front elevation view of the apparatus of FIG. 9.
Figure 9:
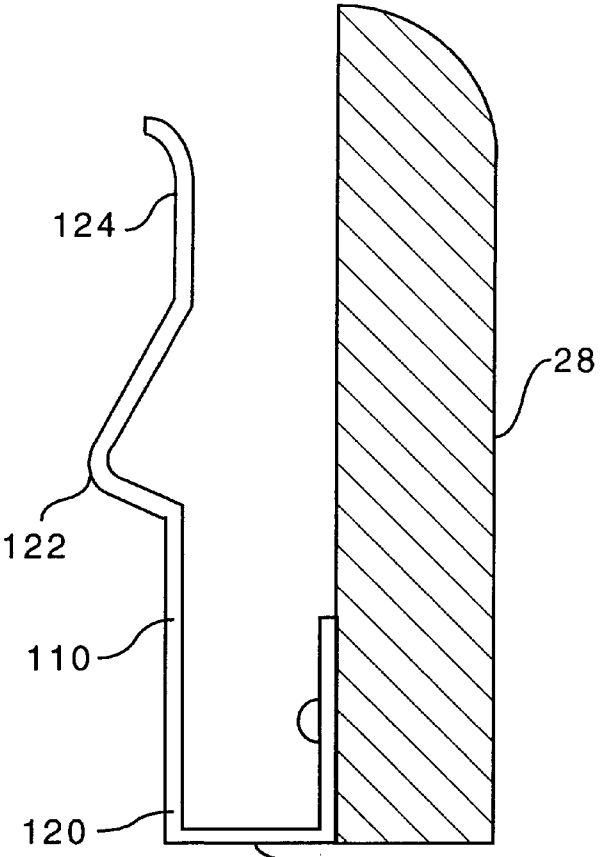
FIG. 9 is a cross-sectional view showing a fourth embodiment of a tension clip apparatus according to the present invention for mounting a baseboard to a wall.

FIGS. 9 and 10 illustrate an embodiment of the invention in which a tension clip 110 and spacer 112 are integrally formed as a single component. Referring to FIGS. 9 and 10, a flange 114 is mounted to a conventional baseboard 28 by suitable fasteners 116 and 118. The spacer portion 112 extends perpendicularly from the flange 114 a distance approximately the thickness of the wall 20 of FIG. 1. The tension clip 110 has a thin, straight section 120 that extends perpendicularly from the spacer portion 112. The space between the section 120 and the baseboard is approximately equal to the thickness of the wall 20. A portion 122 of the tension clip 110 has a lower portion that extends away from the baseboard 114 a distance greater than the thickness of the wall and an upper portion that angles back toward the baseboard. The tension clip further has an upper straight section 124 that is generally parallel to the baseboard and spaced apart therefrom by a distance that is approximately the thickness of the wall 20.

Figure 12:
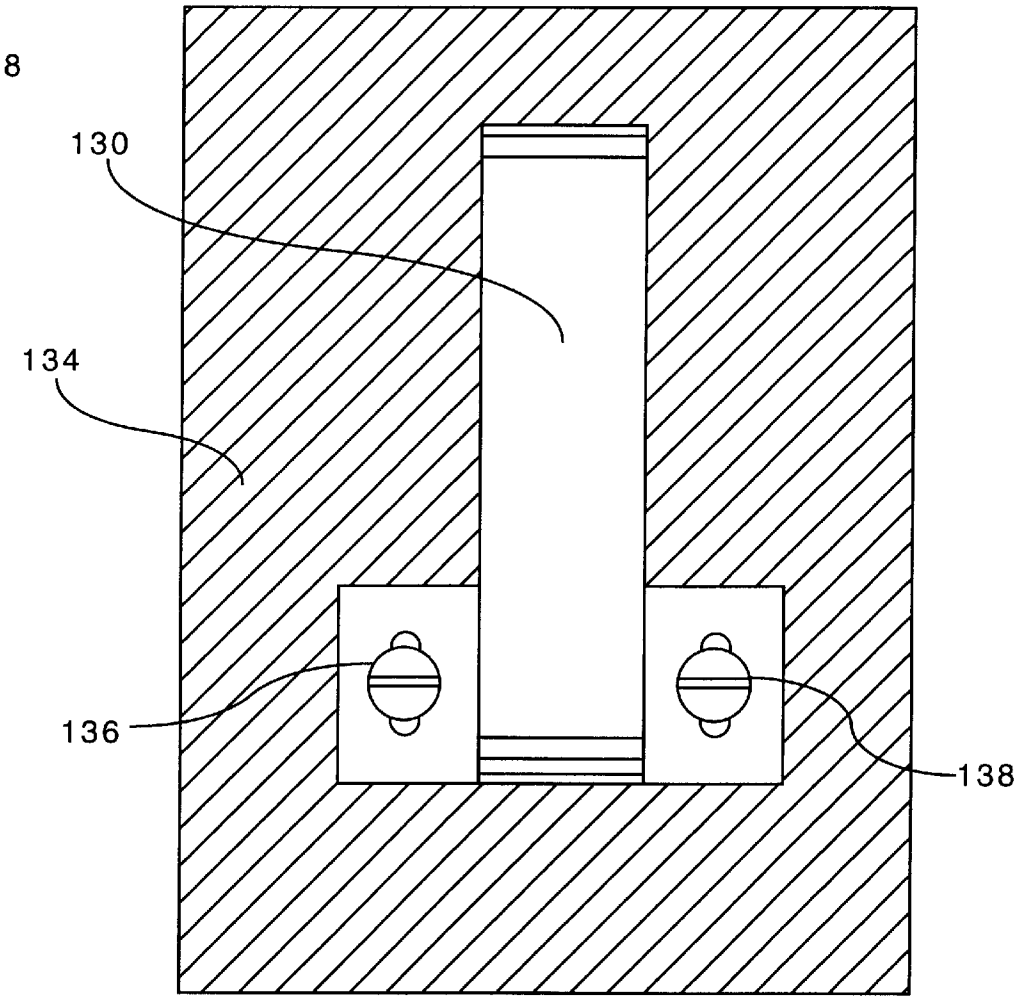
FIG. 12 is a front elevation view of the apparatus of FIG. 11.
Figure 11:
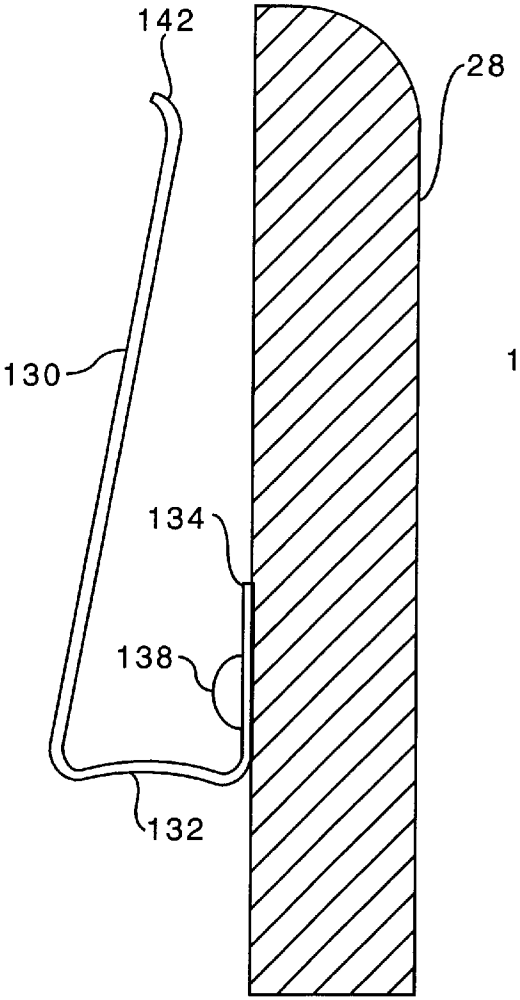
FIG. 11 is a cross-sectional view showing a fifth embodiment of a tension clip apparatus according to the present invention for mounting a baseboard to a wall.

FIGS. 11 and 12 illustrate another embodiment of the invention in which a tension clip 130 and a spacer 132 are integrally formed. A mounting flange 134 extends perpendicularly from the spacer 132. A pair of fasteners 136 and 138 mount the flange 134 to the back side 140 of the baseboard 28. The tension clip 130 extends from the spacer at an end distal from the mounting flange 134. The tension clip 130 preferably makes an angle of about 75° with the plane of the spacer 132. The spacer 132 has a width that is approximately the thickness of the wall 20. The angle between the spacer 132 and the tension clip 130 causes the upper portion 142 of the tension clip 130 to press against the back surface of the wall 20 when the baseboard 28 is installed.

Figure 14:
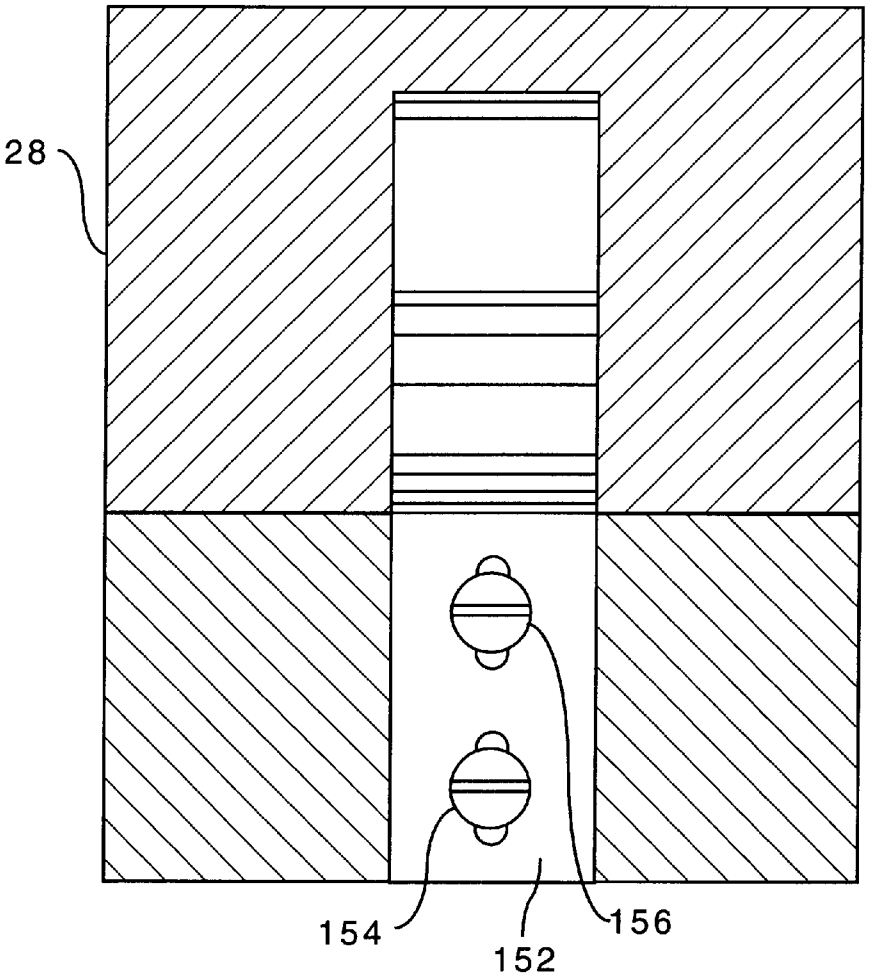
FIG. 14 is a front elevation view of the apparatus of FIG. 13.
Figure 13:
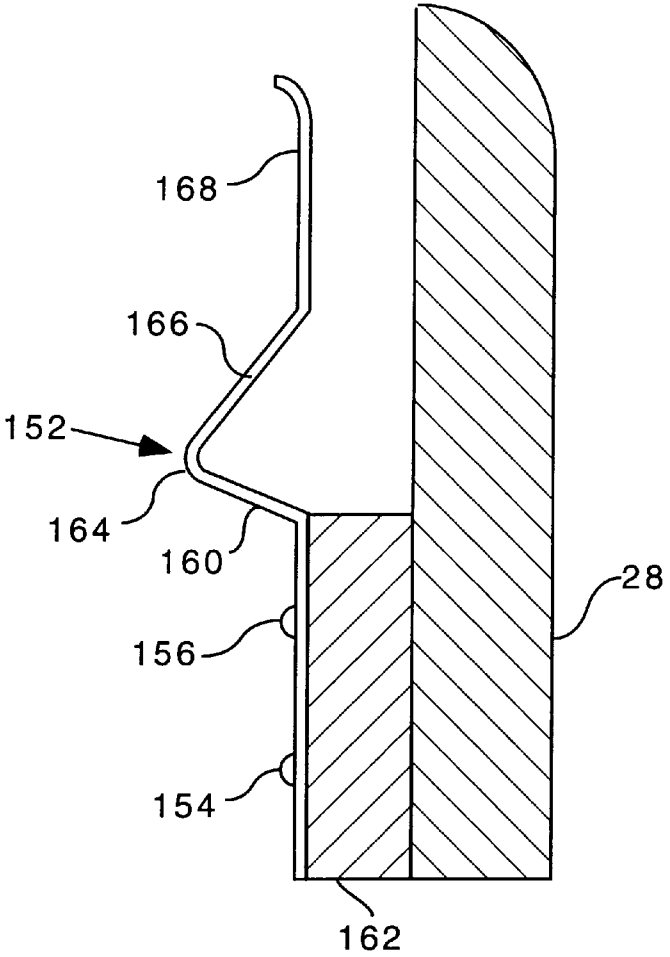
FIG. 13 is a cross-sectional view showing a sixth embodiment of a tension clip apparatus according to the present invention for mounting a baseboard to a wall.

FIGS. 13 and 14 show an embodiment of the invention that includes a separate spacer 150 and a tension clip 152. The spacer 150 is mounted to the baseboard 28 by any suitable fastener or adhesive (not shown). The tension clip 152 has a lower portion 153 that is connected to the spacer 150 by fasteners 154 and 156 or by other suitable means. A portion 160 of the tension clip 152 extends away from the upper edge 162 of the spacer 150. A curved, generally central portion 164 of the tension clip 152 is formed integrally with the portion 160. A generally straight portion 166 of the tension clip 152 extends from the end of the curved portion 164 distal from the portion 160. The upper portion 168 of the tension clip 152 extends from the portion 166 and is generally parallel to the back surface 170 of the baseboard 28.

Figure 16:
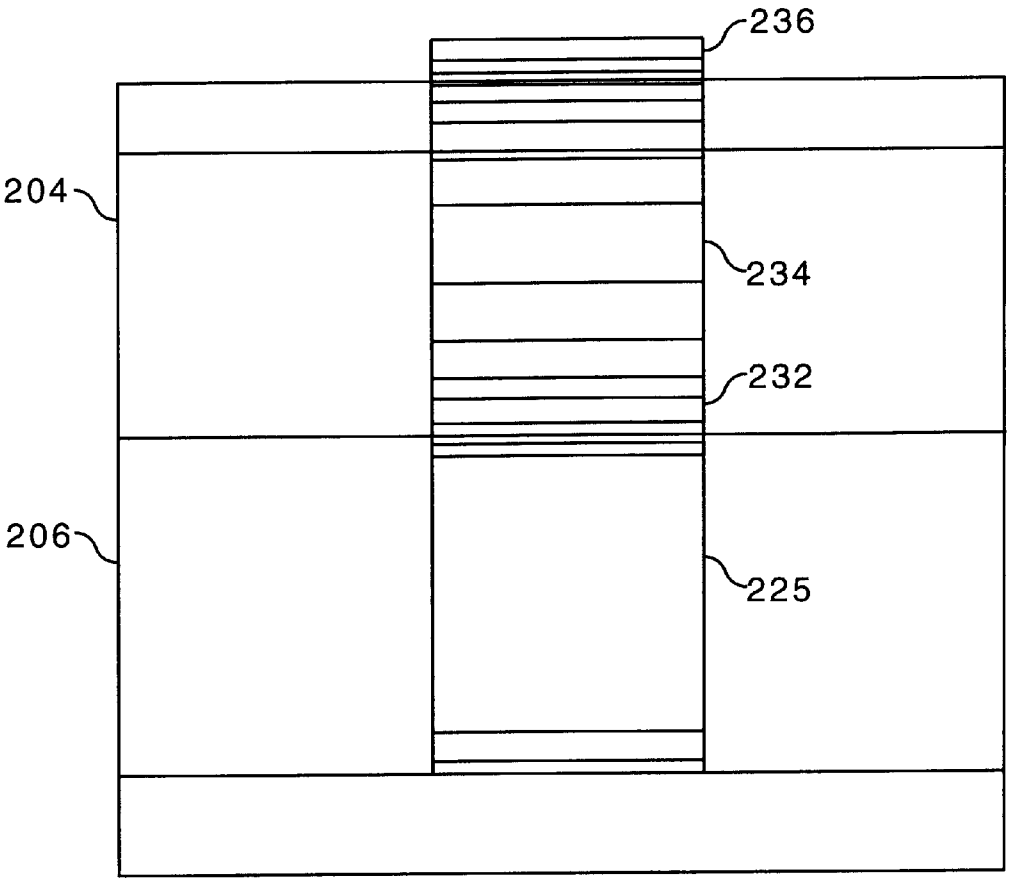
FIG. 16 is a front elevation view of the tension clip apparatus of FIG. 15.
Figure 15:
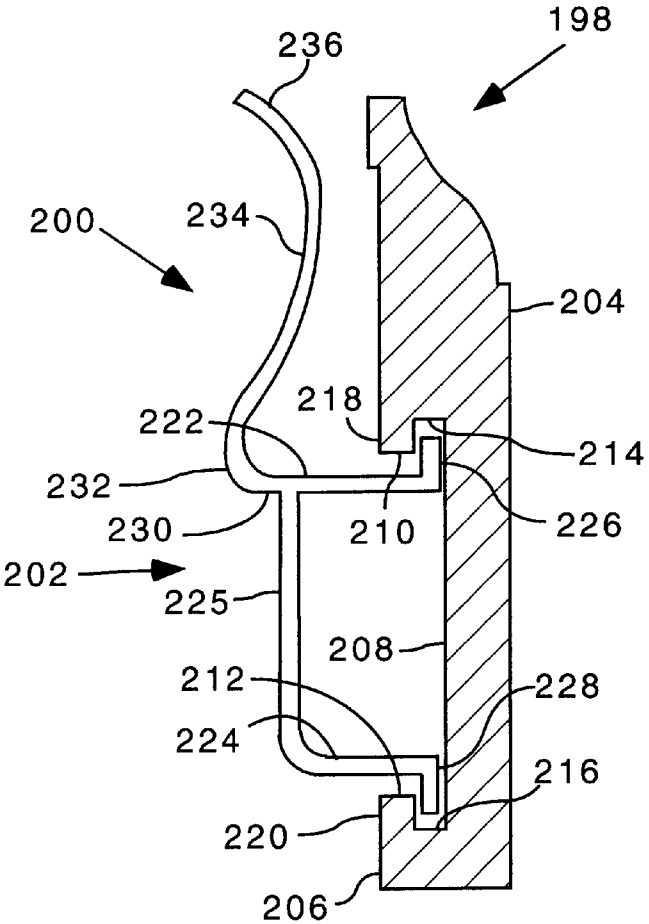
FIG. 15 is a cross-sectional view of a seventh embodiment of a tension clip apparatus according to the present invention for mounting a baseboard to a wall.

FIGS. 15 and 16 show an embodiment of the invention in which a clip assembly 198 includes a tension clip 200 formed integrally with a spacer 202. The tension clip 200 and spacer 202 are designed for connection to a baseboard 204. The back side 206 of the baseboard 204 has a groove 208 formed therein. The groove 208 extends lengthwise along the baseboard 204. The groove 208 has side edges 210 and 212. The side edges 210 and 212 of the groove include slots 214 and 216, respectively, which undercut the baseboard material and form projections 218 and 220 that extend over the slots 214 and 216, respectively.

The spacer portion 202 may be formed as a pair of generally parallel members 222 and 224 arranged between an elongate member 225 that maintains a spacing of about 1" to 1.5" between the parallel members 222 and 224. The members 222 and 224 have oppositely directed end projections 226 and 228, respectively that are arranged to fit within the groove 208. As shown in FIG. 15, the end projections 226 and 228 extend up and down, respectively when they are installed on the baseboard 204. The spacer portion 202 may be securely attached to the baseboard 204 by placing the projections 226 and 228 within the slots 214 and 216, respectively. The projections 218 and 220 of the baseboard thus extend over the projections 226 and 228, respectively, of the spacer 202 to mount it to the baseboard 204. The dimensions of the spacer portion 202 and the groove 208 preferably are such that tensile forces in the spacer portion 202 retain the projections 226 and 228 within the slots 214 and 216, respectively when the spacer portion 202 is installed in the baseboard 204.

The tension clip 200 preferably is formed to have a lower portion 230 that extends from the member 222 of the spacer portion 202. As shown in FIG. 15, the lower portion 230 preferably is collinear with the member 222 so that when installed, the lower portion 230 is generally horizontal.

The tension clip 200 is preferably further formed to include a first curved portion 232 that extends from the lower portion 230. The curved portion 232 is curved upwardly through an arc that causes it to turn back toward the baseboard 204. As shown in FIG. 15, the first curved portion 232 is curved to be concave with respect to the back side 206 of the baseboard 204. The tension clip 200 preferably includes a second curved portion 234 that extends from the first curved portion 232. The second curved portion 234 is convex with respect to the baseboard 200. Therefore the smallest spacing between the tension clip 200 is at near the center of the second curved portion 234. The second curved portion terminates at and upper end 236 of the tension clip 200. The upper end 236 extends away from the baseboard at an angle, which facilitates mounting the baseboard 200 to a wall as previously explained for other embodiments of the invention.

When the baseboard 200 and clip assembly 198 are mounted to the wall, the central region 240 of the second curved portion presses against the back surface of the wall while the back surface 206 of the baseboard 200 presses against the front surface of the wall. The elastic force in the tension clip 200 thus retains the baseboard 204 and the clip assembly 198 in position on the wall in the manner previously described.

An important feature of the invention is the simple and easy installation procedure. Installation of standard baseboards is time consuming because of the requirement of precise cutting to the lengths require to form corners at walls. The baseboard system according to the present invention includes pre-formed corner structures for both inside and outside corners.

Figure 17:
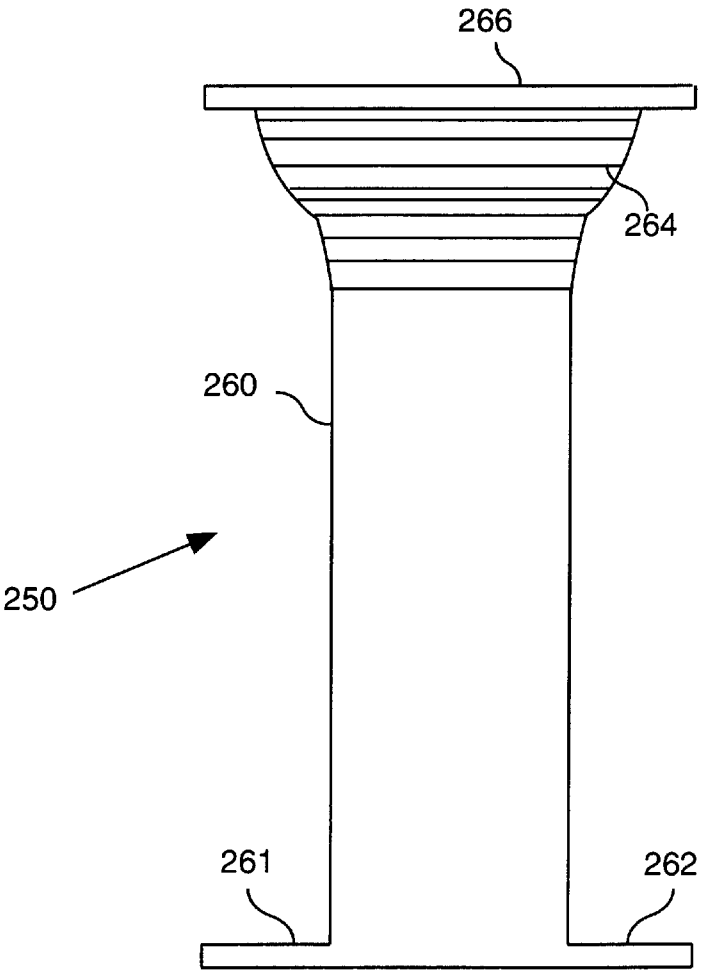
FIG. 17 is a front elevation view of a corner module for forming an inside corner at a junction of two baseboards.
Figure 18:
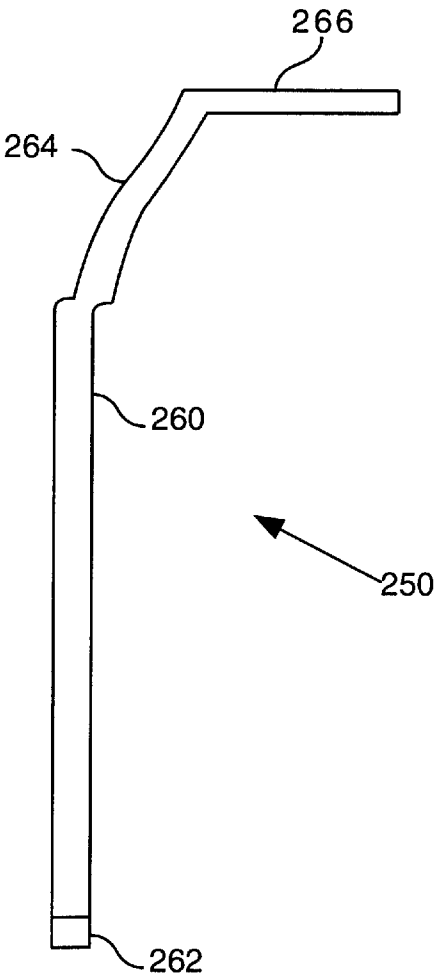
FIG. 18 is a side elevation view of the corner module of FIG. 17.
Figure 19:
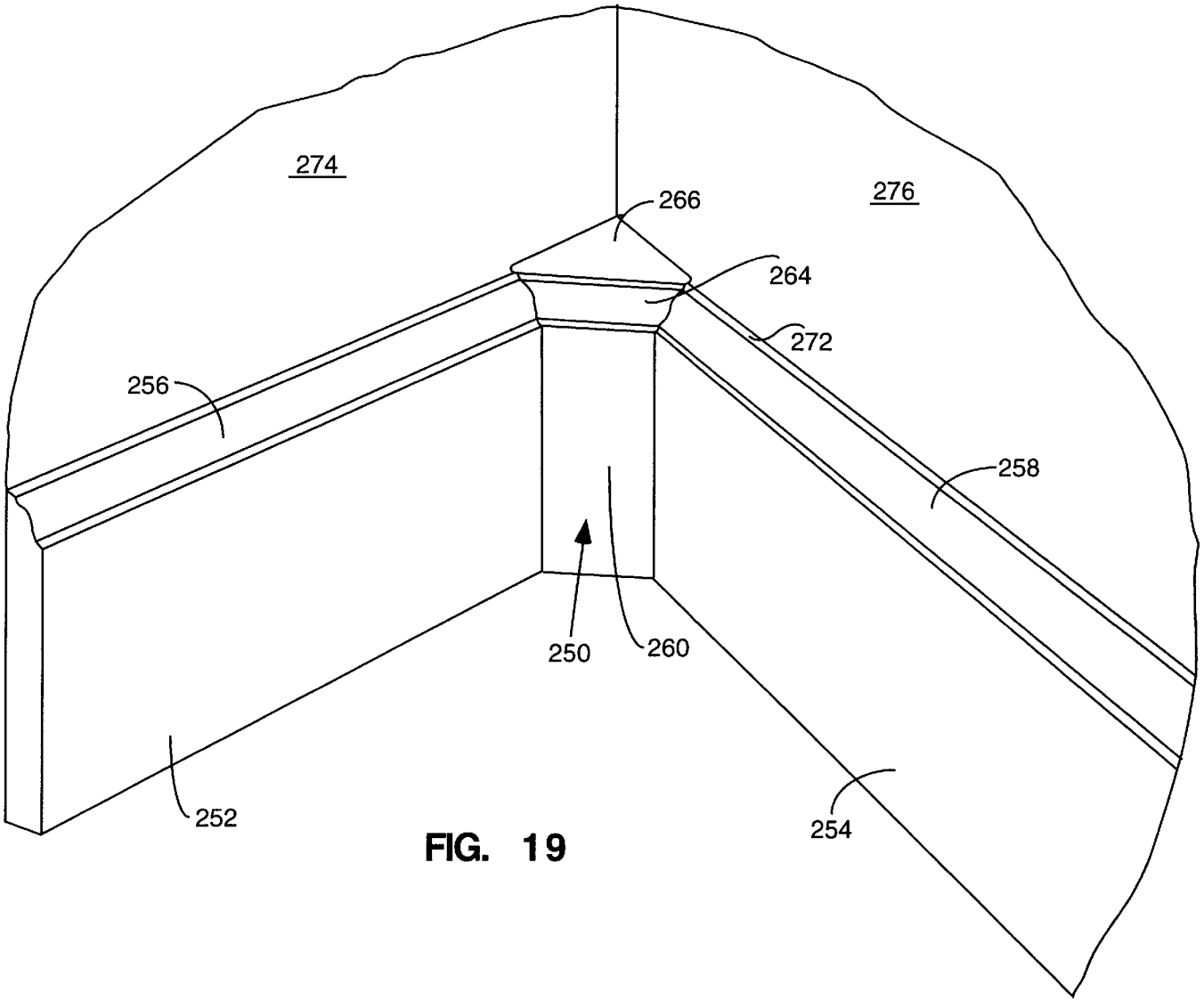
FIG. 19 is a perspective view of showing the corner module of FIGS. 17 and 18 installed at a corner at the intersection of two baseboards at an inside corner.
Figure 21:
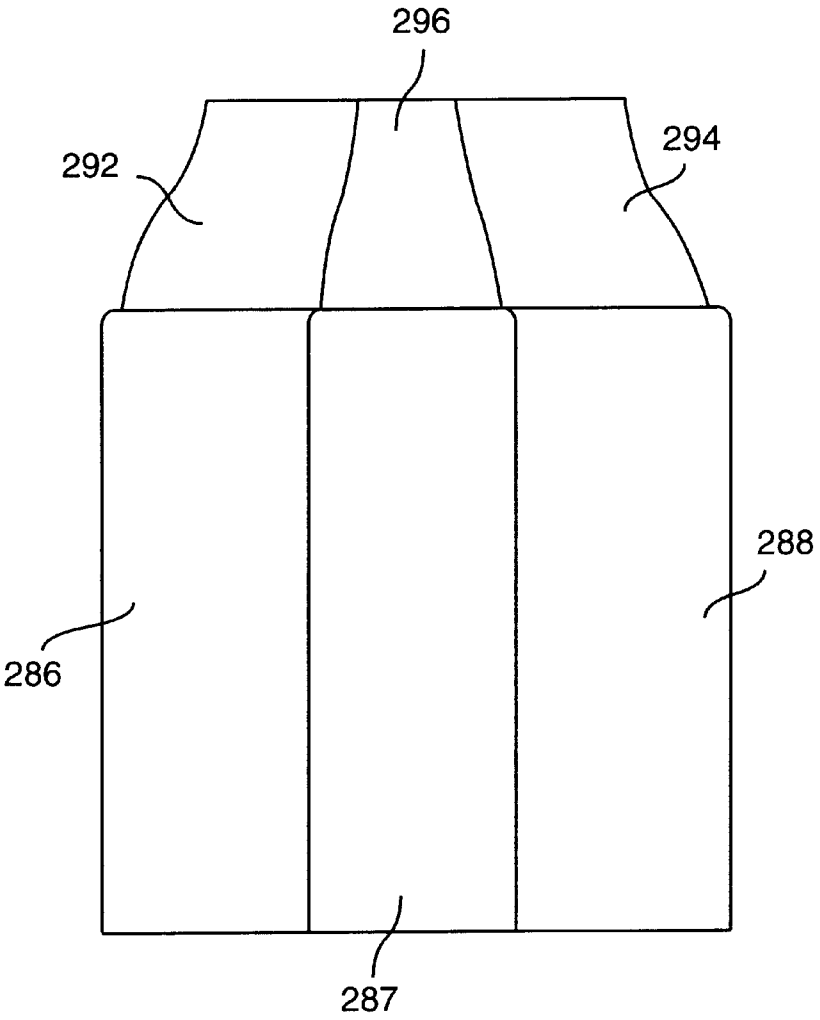
FIG. 21 is a front elevation view of the corner module of FIG. 20.
Figure 20:
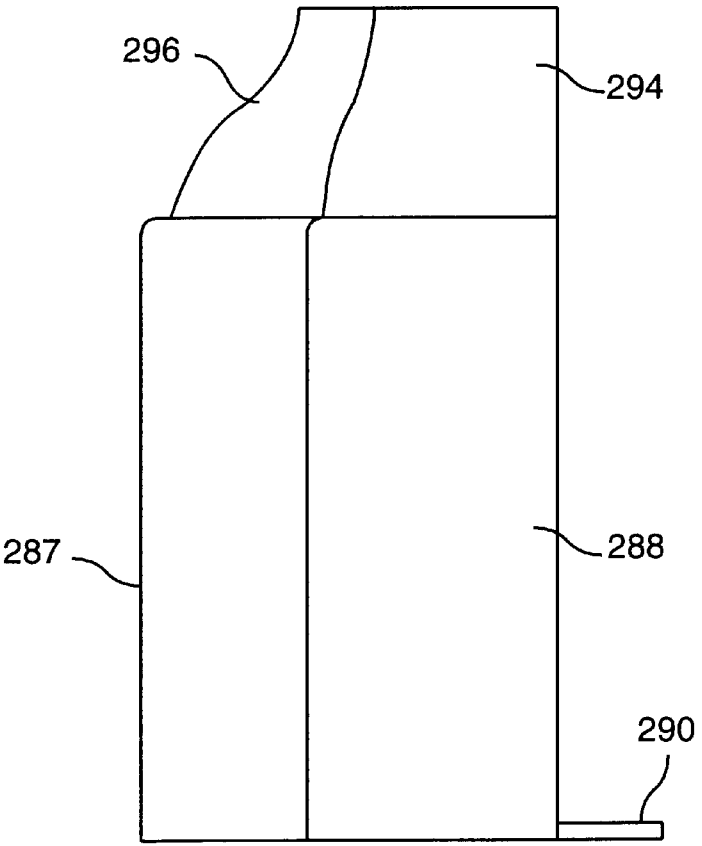
FIG. 20 is a side elevation view of a corner module for forming an outside corner at a junction of two baseboards.
Figure 23:
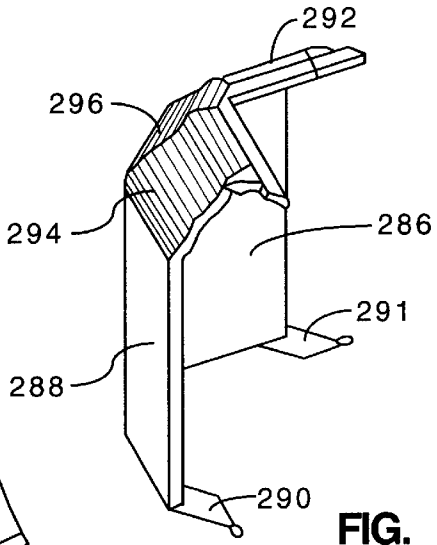
FIG. 23 is a perspective view of the corner module of FIGS. 20–22.
Figure 22:
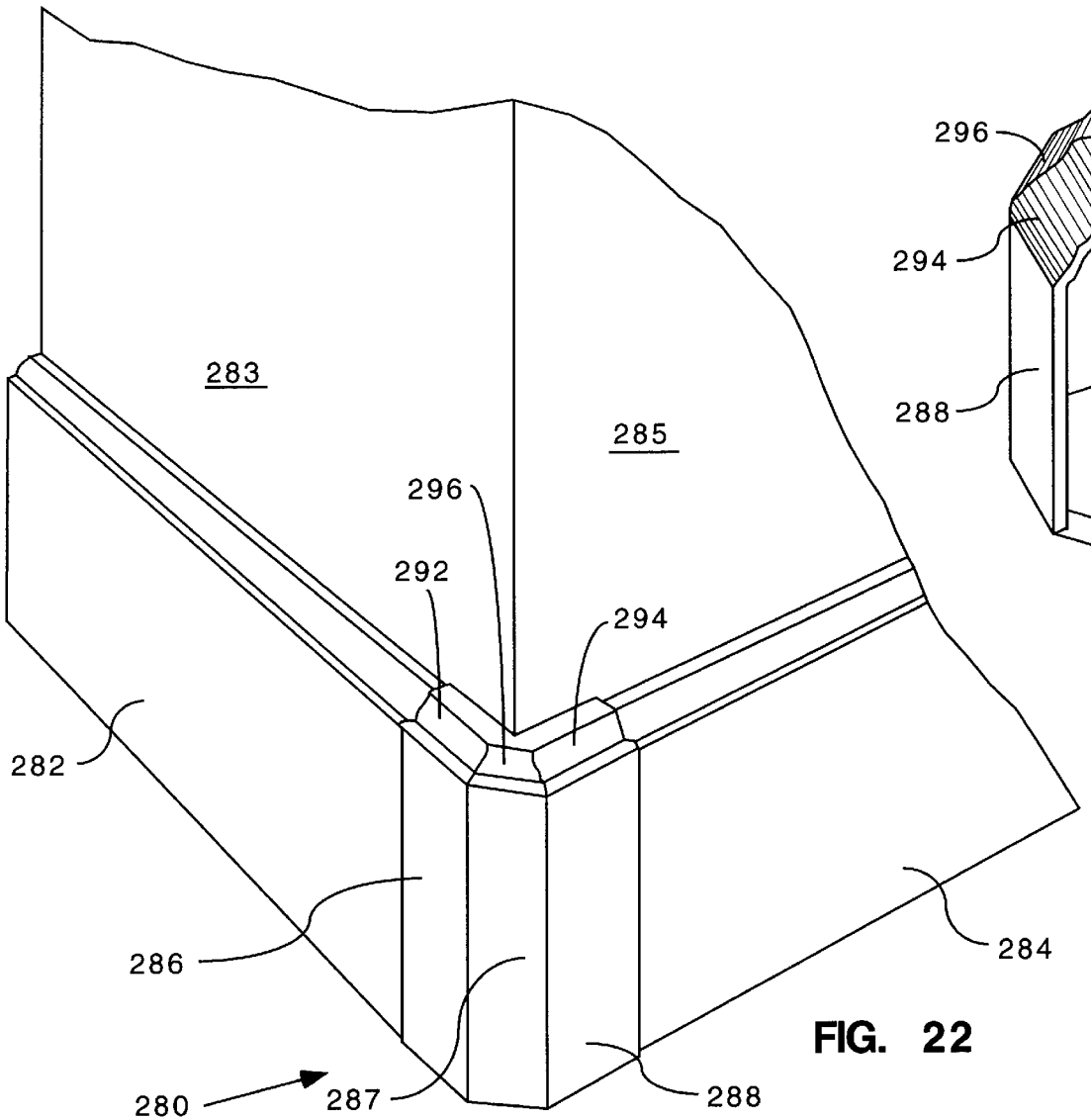
FIG. 22 is a perspective view of showing the corner module of FIGS. 20 and 21 installed at a corner at the intersection of two baseboards at an outside corner.

FIGS. 17–19 illustrate an inside corner module 250 formed for installation at a corner between two baseboards 252 and 254. A typical baseboard has been shaped or routed to have a decorative upper edge. The corner module 250 is formed to blend smoothly with the upper edges 256 and 258 of the baseboards 252 and 254, respectively. The particular shape of the upper edges 256 and 258 shown in FIG. 19 is merely by way of example. The upper edges 256 and 258 may have any shape that is convenient for a baseboard.

The corner module 250 has an upright portion 260 that has a length generally equal to the width of the flat portion of the baseboards 252 and 254. A pair of base members 261 and 262 extend from opposite sides of the bottom of the upright portion 260. The base members 261 and 262 are very thin and a have thickness of about 0.02" to 0.06" so that when the corner module 250 is installed, the base members 261 and 262 extend under the lower edges of the adjacent baseboards 252 and 254, respectively. The corner module 250 also includes an upper portion 264 that is preferably formed to conform to the edges 256 and 258 of the baseboards 252 and 254. A cap 266 that preferably is formed generally as a triangle extends over the upper portion 266 and the uppermost portions 270 and 272 of the baseboards 252 and 254 to fit closely against the walls 274 and 274 upon which the baseboards 252 and 254 are mounted.

Installing the corner module 250 involves first installing baseboards 252 and 254 with their ends arranged so that the corner module will cover them. The corner module 250 may then be arranged with the base portions 261 and 262 adjacent the floor. The corner module 250 may then be moved into the corner. It may be necessary to raise the ends of the baseboards 252 and 254 a small distance above the floor so that the base portions 261 and 262 will fit under them. After the cap 266 is arranged to cover the uppermost edges 270 and 272 of the baseboards, the baseboards 252 and 254 are moved downward so that the baseboards and the base portions 261 and 262 are adjacent the floor. If desired, a small, thin portion of the lower edges of the ends of the baseboards 252 and 254 may be removed to accommodate the thickness of the base portions. In general, the narrow dimension of the thickness of the base portions and floor irregularities make it unnecessary to trim the ends of the baseboards 252 and 254.

FIGS. 20–23 illustrate an outside corner module 280 for mounting where a pair of baseboards 282 and 284 meet at a corner formed by two walls 281 and 283. The corner module 280 preferably includes three upright portions 286–288. The upright portions 286 and 288 fit over the ends of the baseboards 282 and 284. The upright portion 287 is arranged to be between the upright portions 286 and 288 at the center of the corner and to give a beveled effect to the corner. The upright portions 286 and 288 are preferably formed to be essentially identical with the only difference being that the upright portion 286 forms the left side of the module 280 whereas the upright portion 288 forms the right side.

A base portion 290 extends from the bottom of the upright portion 288. A similar base portion 291 (shown in FIG. 23) extends from the bottom of the upright portion 286. When the corner module 280 is installed on the baseboards 282 and 284, the base portions 290 and 291 extend under the baseboards 282 and 284 and are not visible.

The corner module 280 includes an upper edge portion 292 that extends above the upright portion 286. The upper edge portion 292 preferably is shaped to conform to the shape of the upper edge of the baseboard 282. A similar upper edge portion 294 extends above the upright portion 288. An upper edge portion 296 extends from the upright portion 287. The upper edge portion 296 preferably is formed to extend laterally between the upper edge portions 292 and 294 to complete the beveled effect on the corner. The thickness of the corner module 280 preferably is about 5/32".

Installing the corner module 280 involves first installing the baseboards 282 and 284 with their ends cut so that they will extend under the upright portions 286 and 288. The base portions 289 and 291 are slid under the baseboards 282 and 284, and the upper edge portions 292 and 294 are closely adjacent the corresponding walls 283 and 285.

The structures and methods disclosed herein illustrate the principles of the present invention. The invention may be embodied in other specific forms without departing from its spirit or essential characteristics. The described embodiments are to be considered in all respects as exemplary and illustrative rather than restrictive. Therefore, the appended claims rather than the foregoing description define the scope of the invention. All modifications to the embodiments described herein that come within the meaning and range of equivalence of the claims are embraced within the scope of the invention.

What is claimed is:

1. A snap-on baseboard assembly comprising:

a wall panel having a front surface, a rear wall surface, a lower edge and a wall panel thickness;

a baseboard arranged to be mounted adjacent the front surface of the wall panel and generally parallel to the lower edge, the baseboard having a selected width and a lower baseboard portion that extends below the lower edge of the wall panel;

a spacer extending from the lower baseboard portion, the spacer having a spacer thickness that is approximately the same as the wall panel thickness and having a width that is less that the baseboard width, the spacer further having a rear spacer surface that is arranged to be generally coplanar with the rear wall surface when the baseboard is installed on the wall panel, the rear spacer surface having a horizontal slot formed therein and also having a horizontal tongue and groove configuration formed in an upper edge portion thereof;

a tension clip having a first end connected to the spacer and a second end that extends from the spacer and is arranged for placement below the lower edge of the wall panel such that the lower baseboard portion may be manually rotated toward the lower edge of the wall to place the spacer under the lower edge of the wall and to engage the second end of the tension clip with the rear surface of the wall to demountably fasten the baseboard on the wall;

a prong formed on the tension clip and configured to extend into the groove;

a spring portion connected to the prong and extending generally upward from the tongue so that the lower portion of the wall is retained between the spring portion and the baseboard when the baseboard is installed on the wall panel; and a projection formed in the spring portion and configured to extend into the horizontal slot, the projection and the prong being arranged to provide a compressive force on the tongue to retain the tension clip in connection with the spacer.

2. A snap-on baseboard assembly, comprising:

a wall panel having a front surface, a rear wall surface, a lower edge and a wall panel thickness the wall panel being arranged such that the lower edge is spaced apart by a selected distance from a floor;

a baseboard having upper and lower edges and front and back sides;

a spacer mounted to the back side of the baseboard and arranged for placement between the lower edge of the wall and the floor when the baseboard is mounted to the wall;

a tension clip connected to the spacer and having an end that extends from the spacer behind the wall, the tension clip being arranged to exert a compressive force on the wall to retain the baseboard in a selected position adjacent the lower edge of the wall;

a first corner module for mounting at an inside corner formed where a first pair of baseboards meet, the first corner module including:

a base portion arranged to be inserted under the lower edges of the first pair of baseboards to mount the first corner module to the first pair of baseboards;

an upright portion extending from the base portion to the upper edges of the first pair of baseboards; and a top potion extending from the upright portion to cover the upper edges of the second pair of baseboards; and a cap formed to extend from the top portion of the upper edges of the first and second baseboards into the inside corner; and a second corner module for mounting at an outside corner formed where a second pair of baseboards meet.

3. The snap-on baseboard baseboard assembly of claim 2 wherein the second corner module includes:

a base portion arranged to be inserted under the lower edges of the second pair of baseboards to mount the second corner module to the second pair of baseboards;

an upright portion extending from the base portion to the upper edges of the second pair of baseboards; and a top portion extending from the upright portion to cover the upper edges of the second pair of baseboards.

4. A snap-on baseboard assembly, comprising:

a wall panel having a front surface, a rear wall surface, a lower edge and a wall panel thickness the wall panel being arranged such that the lower edge is spaced apart by a selected distance from a floor;

a baseboard having upper and lower edges and front and back sides;

a spacer mounted to the back side of the baseboard and arranged for placement between the lower edge of the wall and the floor when the baseboard is mounted to the wall;

a tension clip connected to the spacer and having an end that extends from the spacer behind the wall, the tension clip being arranged to exert a compressive force on the wall to retain the baseboard in a selected position adjacent the lower edge of the wall;

a first corner module for mounting at an inside corner formed where a first pair of baseboards meet;

a second corner module for mounting at an outside corner formed where a second pair of baseboards meet, the second corner module including:

a base portion arranged to be inserted under the lower edges of the second pair of baseboards to mount the second corner module to the second pair of baseboards;

an upright portion extending from the base portion to the upper edges of the second pair of baseboards; and a top portion extending from the upright portion to cover the upper edges of the second pair of baseboards.

* * * * *